United States Patent [19]

Bradshaw et al.

[11] 4,452,146

[45] Jun. 5, 1984

[54] RAILROAD TRACK TAMPER LEVEL CONTROL SYSTEM

[75] Inventors: Bruce W. Bradshaw; Robert N. Clive, both of Ludington, Mich.

[73] Assignee: Jackson Jordan, Inc., Ludington, Mich.

[21] Appl. No.: 342,788

[22] Filed: Jan. 26, 1982

[51] Int. Cl.[3] ..... E01B 27/17

[52] U.S. Cl. ..... 104/7 R; 33/338; 73/146

[58] Field of Search ..... 104/7 R, 7 B, 8, 12; 33/1 Q, 287, 338; 73/146

[56] References Cited

U.S. PATENT DOCUMENTS

| | | | |
|---|---|---|---|
| 3,381,626 | 5/1968 | Fagan et al. | 104/7 B X |
| 3,706,284 | 12/1972 | Plasser et al. | 104/7 B |
| 3,775,859 | 12/1973 | Sauterel | 33/338 |
| 4,203,367 | 5/1980 | Stewart et al. | 104/7 B |
| 4,341,160 | 7/1982 | Nielsen | 104/8 X |

*Primary Examiner*—Randolph Reese

*Attorney, Agent, or Firm*—Leydig, Voit, Osann, Mayer & Holt, Ltd.

[57] ABSTRACT

A railroad track tamper control system of the type wherein the grade rail is jacked relative to a reference line, the level rail is cross leveled to the grade rail before tamping, and the tamper frame is relatively independent of the jacking; in which a cross level sensor is mounted on the main tamper frame to free it from jacking vibrations and vertical position sensors measure the jacked elevations of both the grade and level rails relative to the tamper frame. The system cross levels the level rail by comparing the elevation of the grade and level rails relative to the tamper frame and adjusting that comparison by any out-of-cross level of the frame sensed by the cross level sensor.

7 Claims, 10 Drawing Figures

RAILROAD TRACK TAMPER LEVEL CONTROL SYSTEM

This invention relates generally to railroad track tamping machines and more particularly concerns a level control system for an on-track automatic tamper.

A railroad tamper surfaces track automatically by establishing a reference line above the track, jacking the track up into the desired relationship with the reference line, and tamping the ties as the track is held jacked so as to establish the track in its new position. U.S. Pat. No. 3,141,418 to Clayborne et al. suggests using a reference line and a sensor for each rail. On track curves, the outside rail is normally positioned higher than the inside rail, called super-elevation, and separate reference lines and/or separate sensors can permit that adjustment.

U.S. Pat. No. 3,144,834 to Stewart suggests using a single reference line and a single sensor to control jacking of the grade rail, and a cross level device to control the jacking of the opposite or level rail. This is conceptually closer to how track was leveled by work gangs before the use of automatic tampers. The Stewart '834 patent discloses a shadow board, on-off type of sensor in which a light beam is aimed at a small area light detector to establish the ends of the reference "line". Raising the shadow board into the light beam until the detector goes from sensing, to not sensing, light establishes the shadow board upper edge elevation on a line between the light source and the detector elevations.

U.S. Pat. No. 3,381,626 to Fagan et al. shows a sensor-cross level tamper control system in which the light beam level reference signal is not merely on-off, but rather is proportional to deviations from the desired reference line. In this case, the "shadow board" is a mask with a horizontal slot creating, in the light beam, a flat plane of light that falls on an elongated sensor consisting of a vertical array of detectors. Such a sensor can produce a signal proportional to the distance the mask is from reaching the reference line height, which is defined by the flat beam of light falling on the null position of the detector array.

With cross level sensors being on the jacking frame itself, it was found that as tamper operating speeds increased, the sensors oscillated with the jolting movements of the jacks so that they "hunted". If the sensors were heavily dampened to avoid hunting, they would respond slowly and thus limit tamping production speeds. For on-off, shadow board sensors, one approach to this problem is shown in U.S. Pat. No. 3,298,105 to Stewart et al., suggesting a return to a two sensor system, each sensing a reference line over a respective rail, with the cross level sensor being operable to adjust the relative vertical heights of the sensors. This does have the effect of separating the cross level sensor from those portions of the tamper directly affected by the jacking operation. However, this approach did not answer the problem for machines using the proportional sensors referred to above—perhaps because of the proportions of the basic machine itself.

Accordingly, it is the primary aim of this invention to provide a level control system for a tamper in which the cross level sensor is virtually unaffected by jacking movement and vibration, but which permits reference line sensors, including those of the proportional signal type, to remain fixed in their customary vertical positions riding on adjusted track. It is a corollary object of the invention to permit the cross level sensor in such a system to be only lightly damped to prevent hunting so that the sensor remains fast acting and very responsive.

Another object is to provide a system as characterized above in which cross level signals are combined electronically in the control system for more accurate and more flexible adjustment and control of the system.

A further object is to provide a system of the foregoing type which uses rugged, economical and reliable parts so that the tamper and its control system are both initially economical to manufacture, as well as being well suited to meet the operational demands imposed on such equipment.

Other objects and advantages of the invention will become apparent upon reading the following detailed description and upon reference to the drawings, in which.

While the invention will be described in connection with a preferred embodiment, it will be understood that we do not intend to limit that invention to that embodiment. On the contrary, we intend to cover all alternatives, modifications and equivalents as may be included within the spirit and scope of the invention as defined by the appended claims.

Figures 1, 2, 3:
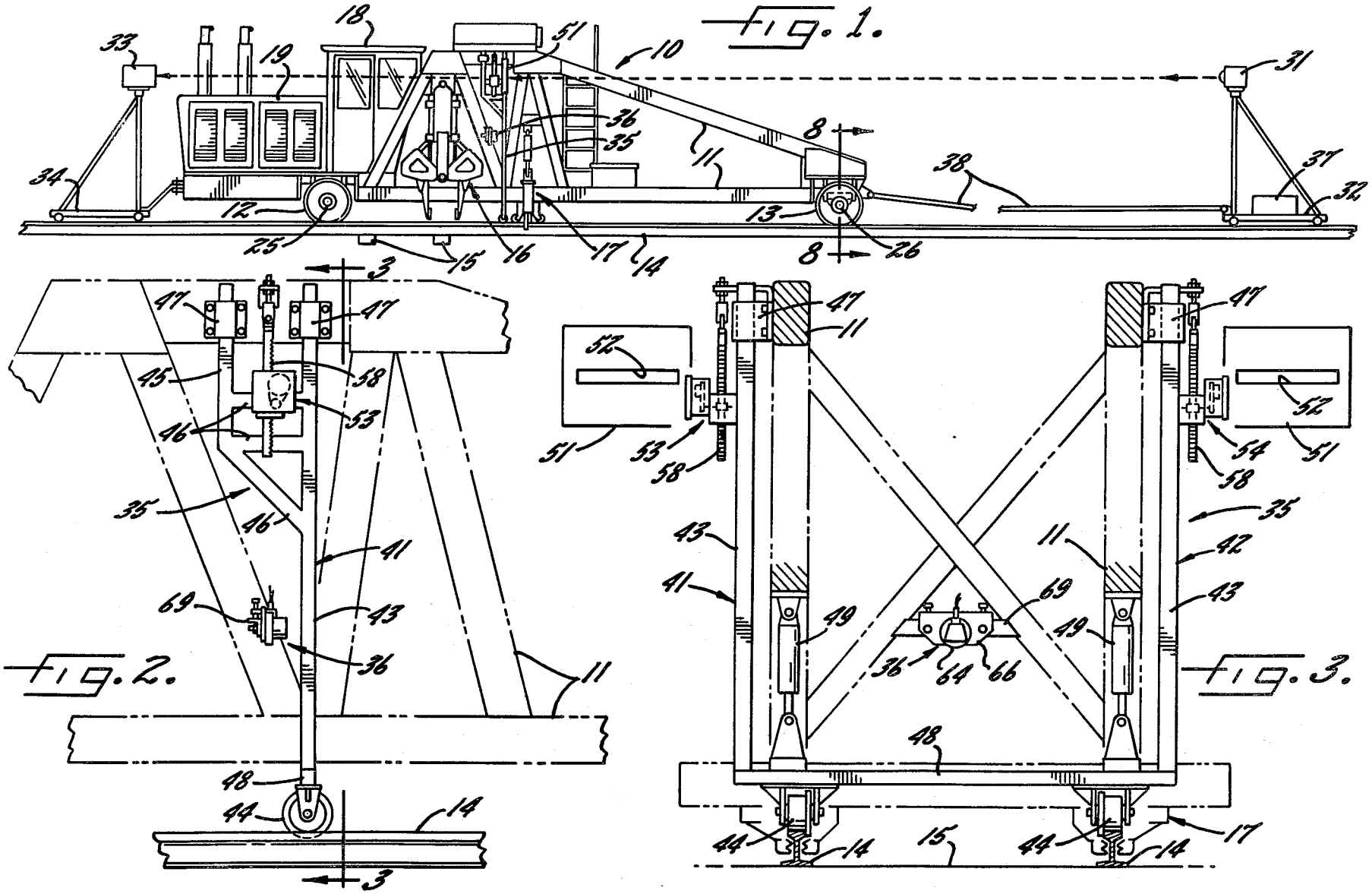
FIG. 1 is a side elevation of a tamper together with reference line equipment embodying the present invention.
FIG. 2 is an enlarged fragmentary elevation of a mid-portion of the machine shown in FIG. 1.
FIG. 3 is a fragmentary section taken approximately along the line 3—3 in FIG. 2.
Figure 4:
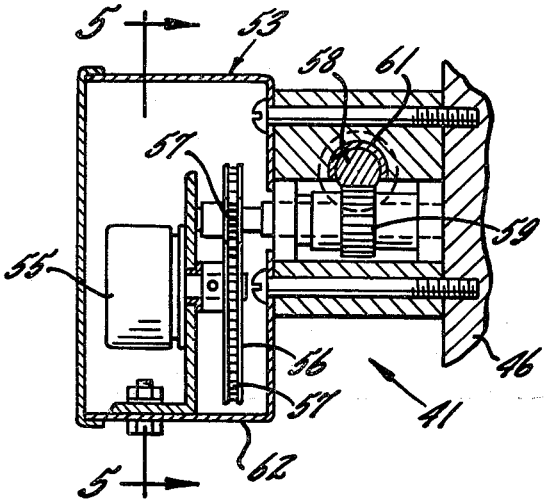
FIG. 4 is a further enlarged vertical fragmentary cross section of a portion of the apparatus shown in FIG. 3.
Figure 5:
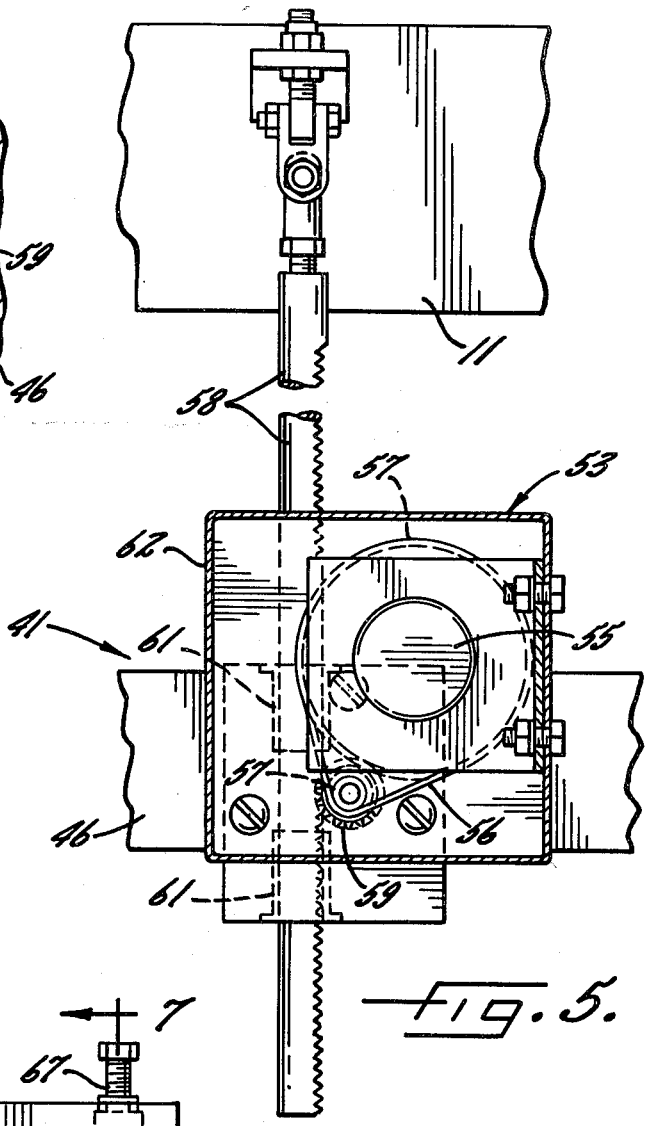
FIG. 5 is a vertical section taken approximately along the line 5—5 in FIG. 4.
Figure 6:
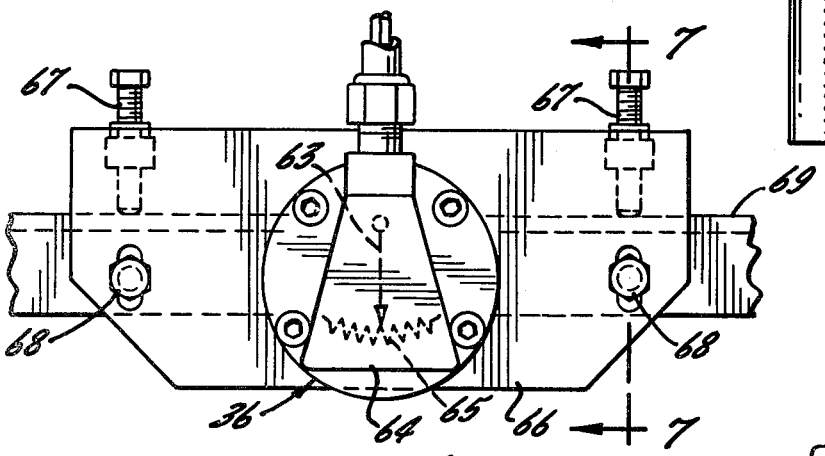
FIG. 6 is a further enlarged, fragmentary and partially schematic elevation of a portion of the apparatus shown in FIG. 3.
Figure 7:
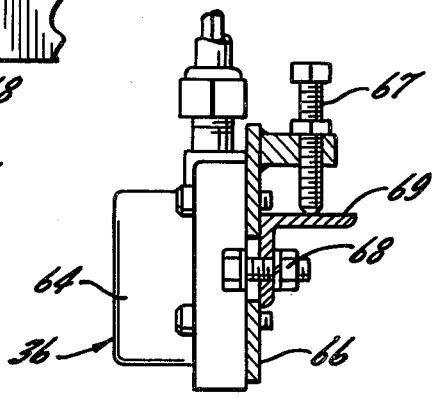
FIG. 7 is a fragmentary section taken approximately along the line 7—7 in FIG. 6.
Figure 8:
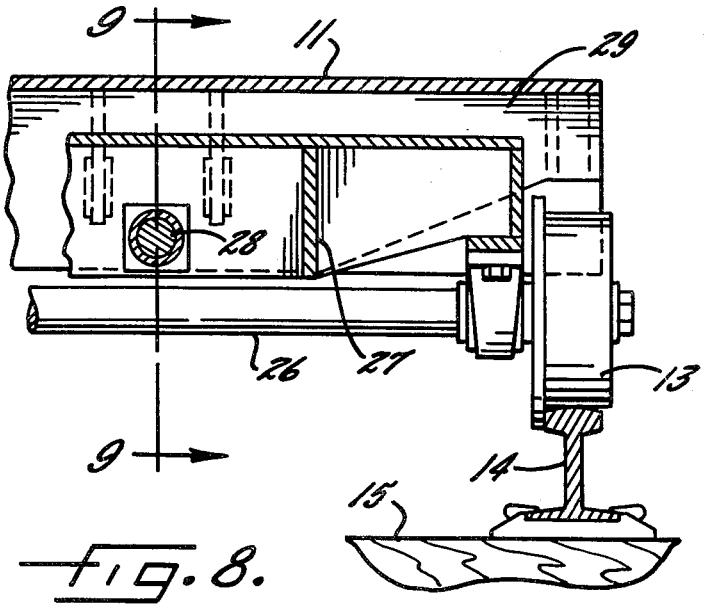
FIG. 8 is an enlarged fragmentary section taken approximately along the line 8—8 in FIG. 1.
Figure 9:
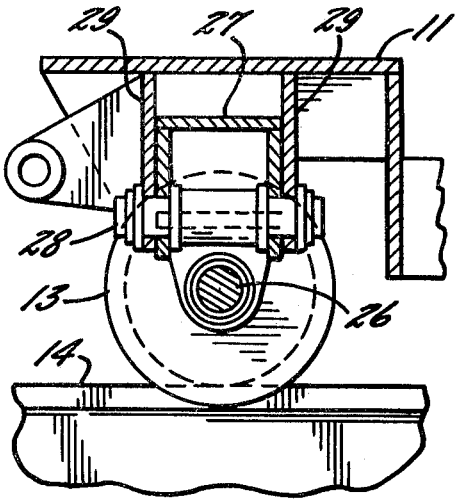
FIG. 9 is a fragmentary section taken approximately along the line 9—9 in FIG. 8.

Turning first to FIG. 1, there is shown an on-track automatic tamper 10 equipped with a control system embodying the invention and including a substantially rigid, truss-like frame 11 with vertically fixed rear wheels 12 riding on adjusted track and vertically tiltable front wheels 13 following unadjusted track—the tamper 10 being effective to surface and tamp as it moves from left to right on the track. The track comprises rails 14 connected by cross ties 15 which are supported in ballast, not shown.

Supported on the tamper frame 11 is a vibratory tamper assembly 16, which may be similar to that shown in U.S. Pat. No. 3,625,156 to Anderson, a rail jacking system 17, which may be similar to that shown in U.S. Pat. No. 3,381,626 to Fagan et al., an operator's cab 18 and a main power plant 19. The jacking system 17 includes left rail and right rail hydraulic lifting cylinders 21 and 22, respectively, controlled by servo valves 23 and 24, respectively (see FIG. 10).

As stated above, the rear wheels 12 are vertically fixed and are mounted on an axle 25 which is journaled in bearings fixed to the frame 11. The front tilting wheels 13 are mounted on an axle 26 journaled on a cross arm 27 which is pivoted on a stub shaft 28 between a pair of plates 29 fixed to the frame 11. The cross arm 27 can rock between the plates 29, and thus the wheels 13 are tiltable relative to the frame. The rear wheels 12 are thus riding on newly surfaced track which has been cross leveled, while the front wheels 13 are free to follow unadjusted track without any torsion being applied to the frame 11. The frame is trusslike to resist torsional deflection.

In carrying out the invention, the tamper control system includes a light source 31 mounted on a carriage 32 for positioning on the track ahead of the tamper 10, a light sensor 33 at the rear of the tamper 10 on a carriage 34 hitched for movement with the tamper, and a rail follower assembly 35 and a cross level sensor 36 both on the tamper frame 11 near the jacking system 17. The light source 31 normally consists of a horizontal battery of incandescent lamps, which may be powered by an independent power source 37 on the carriage 32. The sensor 33 includes a vertical array of light detectors, having a center null region, as shown in said U.S. Pat. No. 3,381,626. The light carriage 32 can either be positioned ahead to a suitable track point, or pushed forward at a fixed distance from the tamper 10 through a plurality of tongue and wheel assemblies 38.

As will be understood by those familiar with the art, when surfacing track, one rail is normally designated the grade rail and is positioned at the desired elevation, and the other rail, the level rail, is cross leveled relative to the grade rail. The light source 31 and the light sensor 33 are positioned vertically over the grade rail, which in the example being discussed is the right rail viewed in the direction of tamper movement. However, since it is desirable to be able to designate either one of the rails as the grade rail, preferably the carriages 32, 34 carry light sources and sensors over each rail, although only one set is operated at one time.

The rail follower assembly 35 includes two rail followers 41 and 42, each consisting of a vertical shaft 43 riding on small track wheels 44 and having a shorter shaft 45 rigidly connected by bars 46 in a position parallel to the vertical shaft 43. The upper ends of the shafts 43, 45 slide in close fitting sleeves 47 fixed on the tamper frame 11 so as to constrict the followers 41, 42 from movement in any direction but vertical relative to the frame. In the illustrated construction, the shafts 43 of the followers 41, 42 are connected to their wheels 44 through a common cross bar 48, but there is sufficient flexibility between the cross bar 48 and the shafts 43 that each rail follower 41, 42 can move vertically independently of the other. Preferably, a pair of linear actuators 49 connect the frame 11 and the cross bar 48 for lifting the rail follower assembly 35 free of the track when not in use.

Each rail follower 41, 42 carries a mask 51 that creates a light-no light interface in the light from the source 31 that falls on the sensor 33. Preferably, the masks 51 are formed with slots 52 to develop flat, horizontal beams of light that allow the sensor 33 to develop a signal proportional to the distance the light beam strikes the sensor 33 from its null position—as discussed in greater detail in said U.S. Pat. No. 3,381,626. As explained above, although each follower 41, 42 has a mask 51, only the mask over the grade rail is utilized in the control system at one time.

Each rail follower 41, 42 and the tamper frame 11 are interconnected by separate vertical positioning sensors 53 and 54 (see also FIG. 10) for developing signals representing the vertical height of the followers relative to the frame. Preferably, these sensors include rotary potentiometers 55 driven, through a short chain 56 and sprockets 57, by a rack 58 and pinion 59. The vertically disposed rack 58 is anchored to the frame 11 and slides in bushings 61 mounted on one of the rail follower bars 46, and the remaining parts of the sensors 53, 54 are mounted and protected within housings 62 also fixed on the follower bars 46. It can be seen that relative vertical movement between a rail follower and the machine frame will rotate the associated potentiometer 55 and allow the generation of a corresponding electrical signal.

The cross level sensor 36 preferably includes a pendulum mass, indicated schematically at 63, suspended in a housing 64 and having an electrical wiper riding on an arcuate resistance coil 65. The housing 64 is fixed to a plate 66 which is secured, by adjusting screws 67 and bolts 68, to an angle iron 69 secured to the frame 11. When the frame 11 tilts laterally from the vertical, the resistance coil 65 is rotated relative to the pendulum mass 63 allowing development of a signal representing and being proportional to the cross level of the tamper 10.

Figure 10:
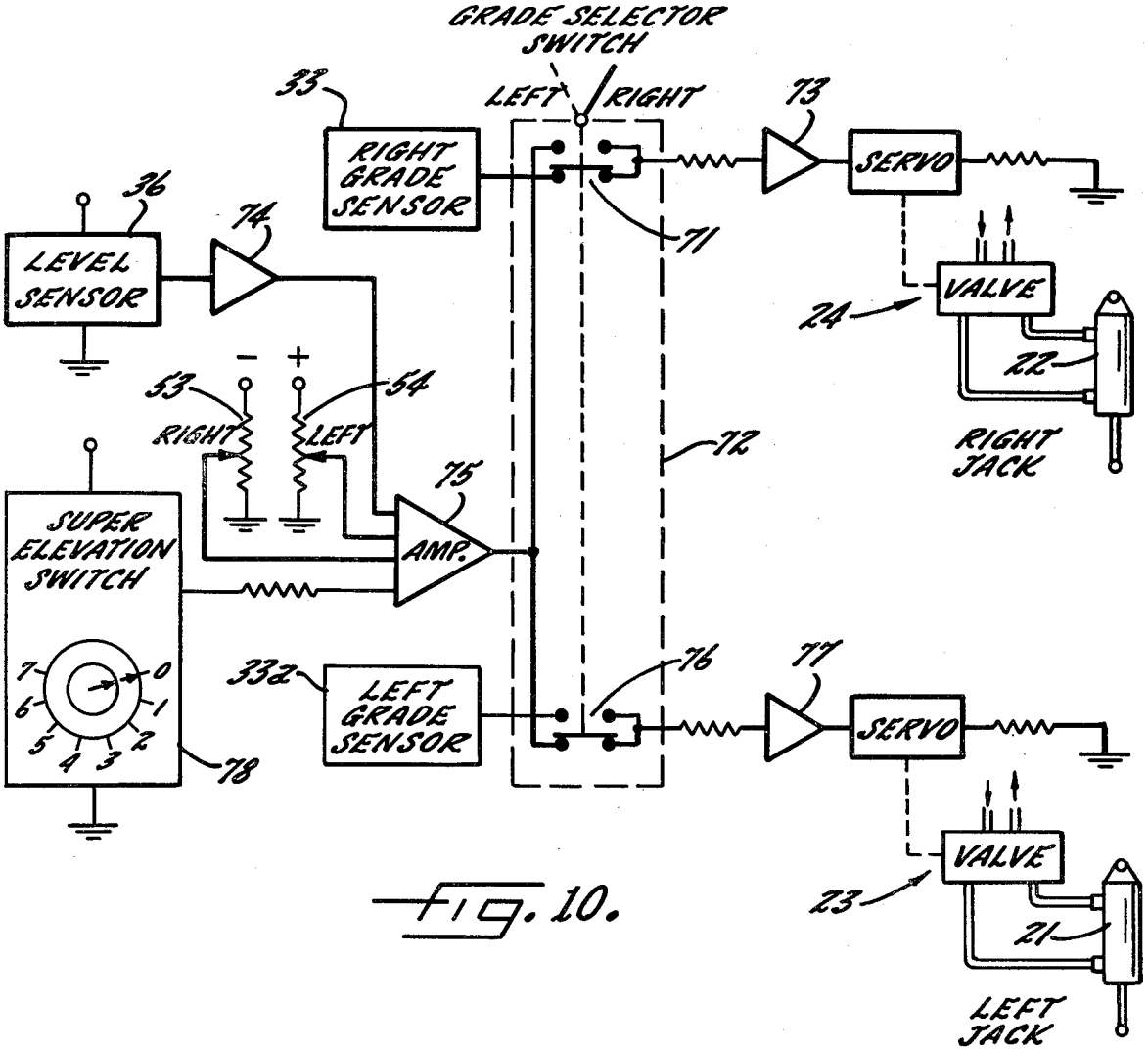
FIG. 10 is a simplified schematic of the control system embodied in the machine of FIG. 1.

In accordance with the invention, the grade rail sensor 33 directly controls the appropriate jack, in this case 22, of the jacking system 17 to lift the grade rail to a level determined by the reference line established by the light source 31, mask 51 and null position of the sensor, and the non-grade or level rail jack, in this case 21, is controlled by the vertical position sensors 53, 54 and the cross level sensor 36 so as to cross level the level rail with the grade rail despite a lack of true cross level of the tamper frame 11. As shown in FIG. 10, the signal from the grade rail sensor 33 passes through contacts 71 of a grade selector switch 72 and an amplifier 73 to cause the servo valve 24 to operate the jack 22 until the signal from the sensor 33 is nulled.

The vertical position sensors 53, 54 send their signals to a comparative amplifier 75 and, when the right grade rail rises, the right sensor 53 delivers a higher signal, assumed to be negative for purposes of this explanation, which unbalances the signal from the left sensor 54 and causes an output signal to be delivered from the amplifier 75 that passes through contacts 76 of the switch 72 and an amplifier 77 to the servo valve 23, which operates the left jack 21 to raise that rail. In this way, the left jack 21 will cause the left rail to follow the right grade rail as it is being raised by the jack 22 until the output of the sensors 53, 54 balance.

It can be understood that as so far described, if the tamper 10 itself was slightly out of true cross level, the rails would be similarly disposed because the vertical position sensors 53, 54 are tied to the frame 11 and its angular position.

However, the cross level sensor 36 also delivers a signal through a matching amplifier 74 to the comparative amplifier 75. If the tamper itself was leaning toward the left, then the left jack 21 would have to lift the left rail higher by the amount of the frame tilt to truly cross level the rails. The cross level signal from the sensor 36 resulting from the frame tilting left is therefore negative, in the illustrated example, requiring a greater lift of the left jack 21 to balance both the cross level signal and the right vertical sensor signal within the comparative amplifier 75. If the tamper itself was tilted to the right, the reverse would be true—a positive signal from the cross level sensor 36 would be added to a similar signal from the sensor 54 and this would not require the left jack 21 to lift as far to achieve a balance within the amplifier 75 using the negative signal from the sensor 53.

As will be apparent from FIG. 10, shifting the grade selector switch 72 changes the grade rail, and "right" and "left" would be reversed in the above description. In this case, a left grade sensor 33A, not otherwise illustrated, would perform the above-described function of the sensor 33.

Preferably, the control circuit also includes a super-elevation switch 78 capable of putting an initial selected signal into the amplifier 75 with the result that the rails would not be leveled to an extent determined by the strength of the signal from the switch 78. This allows the tamper to put, when tamping curved track, a deliberate non-cross level or super-elevation into the surfacing operation.

It can now be seen that the level control system for the tamper 10 utilizes a cross level sensor 36 which is virtually unaffected by jacking movement and vibration since the cross level sensor is mounted on the main tamper frame 11. As a result, the cross level sensor need only be lightly damped to prevent hunting, with the result that the cross level sensor can remain very fast acting and responsive. This permits substantial increases in operating speed and thus increases the daily output of the tamper.

It will also be apparent that the control system combines and utilizes various position-indicating information electronically so that the system is more accurate and more rapid-acting than can be expected of an electro-mechanical system. Furthermore, handling the information electronically provides the opportunity for more flexible adjustment and control of the system.

Those familiar with this art will also realize that the components disclosed and suggested by the foregoing description can be obtained in commercial form as rugged, economical and reliable parts so that the tamper and its control system are initially economical to manufacture. It will also be appreciated that machines such as tamper 10 are often subjected to extremely severe operational demands so that rugged reliable parts promote long, trouble-free operation.

We claim as our invention:

1. A level control system for a tamper having a substantially rigid frame with vertically fixed rear wheels for riding on adjusted track, vertically tiltable front wheels for following unadjusted track, and a jacking assembly between the front and rear wheels for selectively lifting the two track rails relative to the frame, the system comprising, in combination, a light source mounted for positioning on the track ahead of the tamper and directing light back toward the tamper from a given vertical distance above the track, a light sensor mounted at the rear of the tamper for movement with the tamper above one of said rails thus designating that rail as the grade rail, rail followers mounted on said tamper frame near said jacking system to ride on the rails so that each rail has a follower that rises and falls with vertical movement of the respective rail independently of vertical movement of said frame, a mask on the rail follower riding on said grade rail that creates a light-no light interface in the light directed back from said source that falls on said sensor, said sensor developing a signal responsive to the vertical position of said light interface, a cross level sensor mounted on said frame for developing a signal representing the cross level of said frame, a pair of vertical position sensors interconnecting said frame and respective ones of said rail followers for developing signals representing the vertical height of each of said rail followers, and a control circuit for operating said jacking system for lifting the grade rail under control of said signal developed by said light sensor and lifting the non-grade rail until said vertical position sensor signals indicate said rail followers are at equal height, said control circuit also comparing the cross level sensor signal with the vertical position sensor signals so that if the tamper frame is not cross level said jacking system will lift the rails to a true cross level.

2. The combination of claim 1 including having one of said light sensors over each of said rails, one of said masks on each of said rail followers, and means to switch said control circuit so that either rail can be the grade rail.

3. The combination of claim 1 in which said mask is slotted to develop a flat horizontal beam of light, and said light sensor develops a signal proportional to the distance said light beam strikes the sensor from a null position.

4. The combination of claim 1 in which said cross level sensor includes a pendulum mass and produces a signal proportional to angular displacement of said mass and said tamper frame, and said vertical position sensors are rotary potentiometers having rack and pinion connections between the rail followers and the tamper frame.

5. The method of controlling a tamper having a substantially rigid frame with vertically fixed rear wheels for riding on adjusted track, vertically tiltable front wheels for following unadjusted track, and a jacking system between the front and rear wheels for selectively lifting the two track rails relative to the frame, comprising the steps of establishing a reference line above the rail designated as the grade rail, measuring independently the distance both rails are lifted by the jacking system, measuring the cross level of the tamper frame, comparing the distances the two rails are lifted with the frame cross level, and operating the jacking system to lift the grade rail to a position relative to said reference line and to lift the non-grade rail so that the two rails are cross levelled despite a lack of cross level of the tamper frame.

6. The method of claim 5 in which either rail can be selected as the grade rail.

7. The method of claim 5 including the step of adding a desired super elevation value to said comparison of the rail lift distances and cross level so that the jacking system lifts the rails to make their relative elevations different by the amount of said super elevation value, whether or not the frame is cross levelled.

* * * * *